United States Patent [19]

Birillo

[11] Patent Number: 4,793,267

[45] Date of Patent: Dec. 27, 1988

[54] CANTILEVERED SHELF WITH INVISIBLE MOUNTING MEANS

[76] Inventor: Benjamin Birillo, 1045 5th Ave., New York, N.Y. 10028

[21] Appl. No.: 942,957

[22] Filed: Dec. 16, 1986

Related U.S. Application Data

[63] Continuation of Ser. No. 741,181, Jun. 6, 1985, abandoned, which is a continuation-in-part of Ser. No. 584,750, Feb. 29, 1984, abandoned.

[51] Int. Cl.[4] ..... A47B 5/00

[52] U.S. Cl. ..... 108/152; 108/108

[58] Field of Search ..... 108/152, 151, 108, 51.3, 108/921; 248/346, 223.1, 224.3, 225.1; 24/574, 573, 458; 211/153, 147; 411/524

[56] References Cited

U.S. PATENT DOCUMENTS

| | | | |
|---|---|---|---|
| D. 250,800 | 1/1979 | Trossman | D6/574 |
| 676,619 | 6/1901 | Faethe | 108/152 |
| 1,861,100 | 5/1932 | Stanitz | 248/250 X |
| 2,144,602 | 1/1939 | Balmer | 248/250 |
| 2,415,540 | 2/1947 | Simmons | 411/524 |
| 2,842,270 | 7/1958 | Massey | 108/152 |
| 3,363,867 | 1/1968 | Zackrisson | 248/250 |
| 3,587,479 | 6/1971 | Geschwender | 108/51.3 |
| 3,661,099 | 5/1972 | Shelor | 108/51.1 |
| 3,669,035 | 6/1972 | Grossman | 108/152 |
| 3,704,675 | 12/1972 | Bellasalma | 108/152 |
| 3,714,907 | 2/1973 | Michieli | 108/152 |
| 3,754,518 | 8/1973 | Wachtel | 108/152 |
| 4,165,852 | 8/1979 | Chervanak | 108/152 X |
| 4,241,669 | 12/1980 | Giambalvo | 108/152 |
| 4,334,483 | 6/1982 | Kellogg | 248/250 X |
| 4,376,521 | 3/1983 | Walters | 108/152 X |
| 4,385,565 | 5/1983 | Roberts et al. | 108/152 |
| 4,508,301 | 4/1985 | Nicholson et al. | 108/152 X |
| 4,601,247 | 7/1986 | Welch et al. | 108/152 |

FOREIGN PATENT DOCUMENTS

| | | | |
|---|---|---|---|
| 49458 | 10/1934 | Denmark | 248/250 |
| 557409 | 11/1943 | United Kingdom | 411/523 |
| 743841 | 1/1956 | United Kingdom | 248/250 |

*Primary Examiner*—Kenneth J. Dorner
*Assistant Examiner*—José V. Chen
*Attorney, Agent, or Firm*—Kenyon & Kenyon

[57] ABSTRACT

A v-shaped shelf structure has a horizontal shelf part with one end adapted for mounting to a wall and a brace part extending downwardly and rearwardly for the second end of the shelf part, the brace part having an end which rests on the wall, thereby providing support for the shelf part. The shelf structure is provided with mounting means which are invisible when the shelf structure is attached to the wall. The shelf structure in one embodiment contains a honey comb member which comprises the inner portion of the shelf structure, thereby providing a lightweight yet strong shelf.

7 Claims, 2 Drawing Sheets

CANTILEVERED SHELF WITH INVISIBLE MOUNTING MEANS

This application is a continuation, of application Ser. No. 06/741,181, filed 6 June 1985, now abandoned, which is a continuation-in-part of application Ser. No. 584,750, filed Feb. 29, 1984, now abandoned. The present invention relates to a shelf structure, and more particularly, to a light weight, v-shaped shelf having a hidden mounting bracket.

BACKGROUND OF THE INVENTION

Typical of the class of wall mounted shelves are those mounted with elongated standards and brackets. To mount such a shelf, at least two standards must be mounted to a wall using a minimum of two screws in each standard. The brackets are then attached to the standards and the shelf is laid across the brackets. One of the drawbacks of this type of shelf is that to mount just one shelf involves time consuming repetitious steps and often results in a shelf that is not quite horizontal (due to the difficulty in aligning the two separate standards). In addition, this type of shelf suffers aesthetically because the mounting standards and brackets are still exposed after the shelf is installed.

Another problem found with many shelves (including the type described above), is that the shelf, in order to be capable to support any amount of weight at all, must have substantial bulk, and therefore weight, itself. This further complicates the task of mounting the shelf.

Finally, many shelf types must be permanently mounted to a wall with no provision for easy removal, which makes cleaning or painting of the shelf, or the wall behind it, difficult.

It is, therefore, an object of the present invention to provide a shelf structure that is light weight but is capable of supporting a substantial amount of weight.

It is another object of this invention to provide a shelf structure that is sturdy and simple to install.

It is still another object of the present invention to provide a shelf structure with mounting means which, when the structure is mounted on the wall, may not be seen.

Additional objects and advantages will become apparent from the following descriptions and claims in combination with the drawings.

SUMMARY OF THE INVENTION

The objects of the present invention are accomplished by a generally v-shaped shelf structure having a flat generally horizontal shelf part and a downardly and rearwardly directed brace part integrally joined with the front end of the shelf part. The structure is further provided with mounting means for removably attaching the back end of the horizontal shelf part to a support wall or the like such that when the shelf structure is mounted on the support wall the mounting means is invisible. When the shelf is attached, the brace portion is allowed to rest on the support wall at a point below where the mounting means is attached, thus providing support for the front end of the shelf part.

The shelf structure of the present invention may be suitably made from a solid piece of wood, plastic, paper or the like which is bent or otherwise formed into the desired shape. However, in a preferred embodiment, the shelf structure is formed from a frame having a first and a second side frame member, each member having a shelf part and a brace part, the brace and shelf portions forming a mutual acute angle with each other.

The side frame members are joined to each other at each end by a cross piece such that a shelf structure frame is formed. The frame is then covered on both sides with a cover member to form the shelf structure of the present invention. The frame members and cover member define a hollow area within the shelf structure interior. The hollow interior formed inside the frame contains a honeycomb member which gives the shelf its superior strength without adding significantly to the shelf weight.

It will be obvious to one skilled in the art, that the present invention is not only suitable as a shelf but may also be useful as a desk, a bench or other like structures. The dimensions of the shelf structure may be suitably changed in order to be useful in these alternate applications.

DETAILED DESCRIPTION OF THE INVENTION

Figures 1, 3:
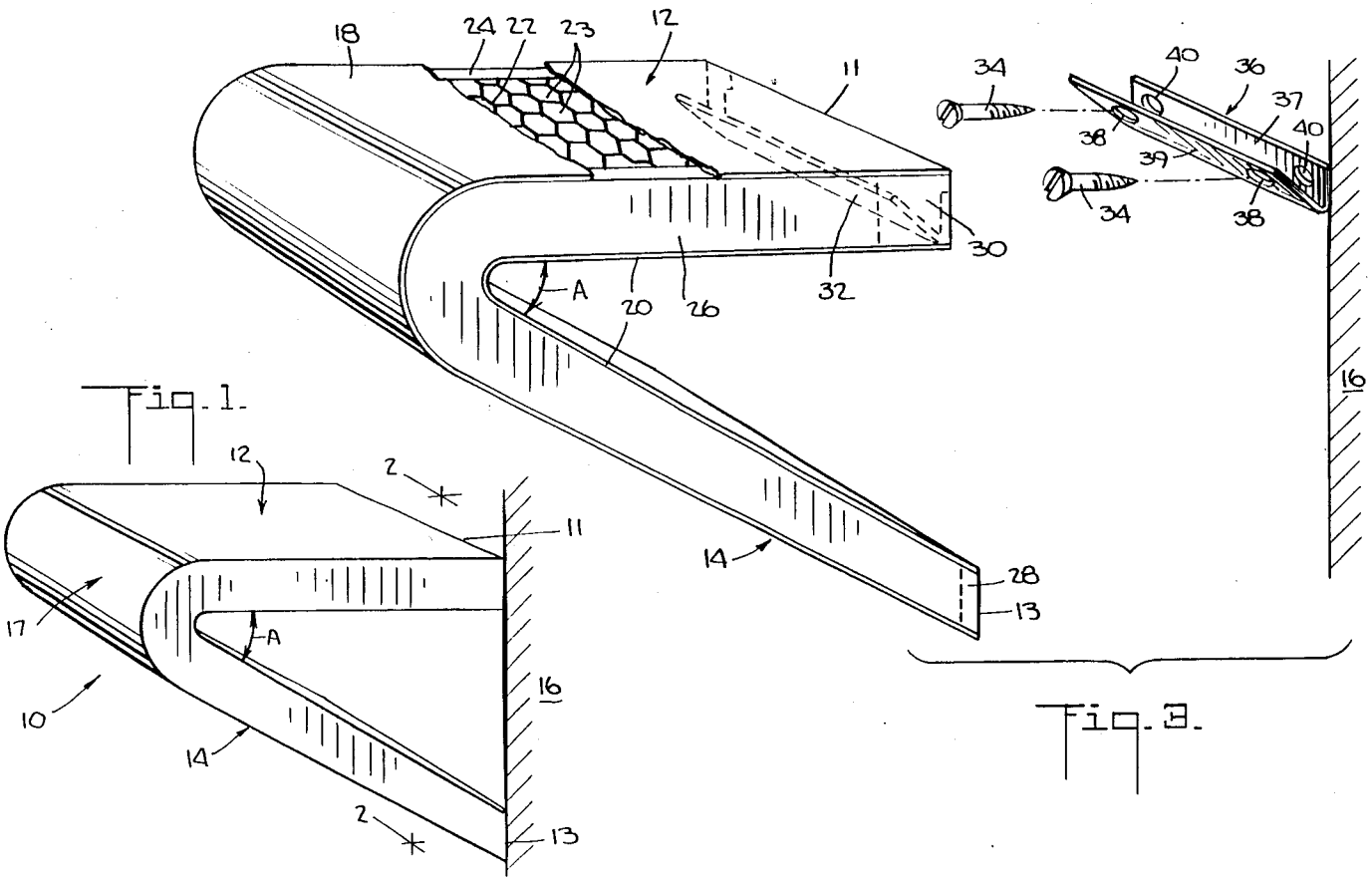
FIG. 1 is a perspective view of the shelf in accordance with the present invention.
FIG. 3 is an exploded view of the shelf of FIG. 2 showing the mounting bracket, fasteners and honeycomb interior.

Referring specifically to the drawings, FIG. 1 shows a shelf structure 10 mounted to a support wall or like structure 16. The shelf structure 10 comprises a horizontal shelf part 12 and a brace part 14. One end 11 (the back end) of the shelf part 12 abuts against the support wall 16 and is removably connected thereto by means of a mounting bracket (not shown in FIG. 1). The brace part 14 which typically has the same width as the shelf part 12, extends downwardly and rearwardly from the front end 17 of the shelf part 12. The back end 13 of brace part 14 which rests on wall 16 and provides support for the front end 17 of the shelf part 12, forms an angle A with the shelf part. The brace part 14 is typically formed integrally with the self part 12.

Figures 2, 4:
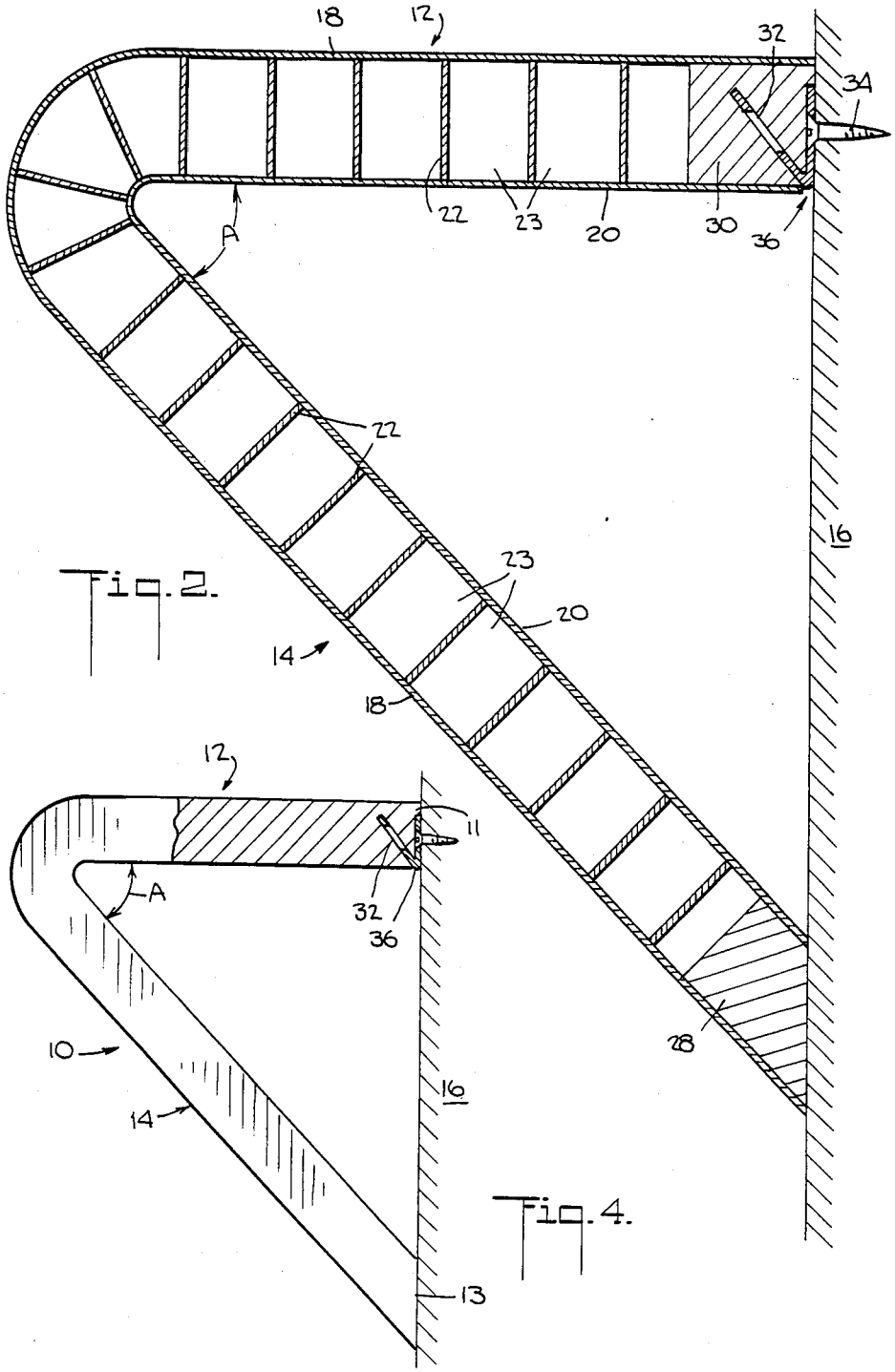
FIG. 2 is a cross-sectional view of the shelf of FIG. 1 taken at line 2—2 showing one embodiment of the present invention.
FIG. 4 is partial broken away side view of another embodiment of the present invention.

In a preferred embodiment, the shelf structure is comprised of a frame with top and bottom cover members, 18 and 20 (see FIG. 2). The frame is comprised of a first side frame member 24 and a second side frame member 26, a shelf end member 30 and a brace end member 28. The two side frame members, 24 and 26, are V-shaped having an angle A so that when the shelf structure 10 is constructed therefrom, the shelf part 12 and brace part 14 are provided for. The shelf end member 30 connects the shelf part end of the first side frame member 24 to the shelf part end of second side frame member 26 to form the back end 11 of shelf part 14. The brace end member 13 connects the brace part end of frame member 24 to the brace part end of frame member 26 thereby forming the brace end 13 of brace part 14.

Shelf end member 30 is provided with a slot 32 which will removably engage the shelf mounting means.

The frame, after being assembled, is covered with an outer and an inner cover member, 18 and 20 respectively. The outer cover 18 forms the top upward facing surface of the shelf part 12 and wraps around the front end 17 of the shelf part 12 and forms the outer downward facing surface of the brace part 14. The inner cover 20 forms the bottom downward facing surface of the shelf part 12 and doubles back to form the inner upward facing surface of the brace part 14.

When cover members 18 and 20 are applied to the frame structure described above, a hollow area is defined within the entire shelf structure 10. The hollow area may be left empty; however, it preferably contains a honeycomb member 22 which provides increased shelf support and strength without adding substantial to the overall weight.

The honeycomb member 22 is typically comprised of a plurality of hexagonally shaped cells, each cell having a hexagonal bore 23 therethrough. The member 22 is sized so that it completely fills the hollow area within the shelf structure 10 and is oriented so that the bores 23 pass from the inner cover 18 to the outer cover 20.

The mounting means in accordance with the present invention is comprised of a V-shaped bracket member 36 having a first leg 37 and a second leg 39. The legs typically form a mutual angle of about 45°. The first leg 37 of bracket 36 is attached to wall 16 in any suitable fashion and the second leg 39 extends outwardly and upwardly therefrom. In mounting the shelf 10 to the support wall 16, a slot 32 formed in shelf end member 30 is slipped over the second leg 39 of the v-shaped bracket 36, thereby providing support for the back end 11 of shelf part 12. In addition, the brace end 13 of brace part 14 is allowed to rest against support wall 16 at a position on the wall 16 which is below the location of the mounting bracket thereby providing support for the front end 17 of shelf part 12.

It will be obvious to one skilled in the art that bracket 36 may be fastened to the support wall 16 in many ways (glue, nails, screws, etc.). Typically, however, the bracket of the present invention will be mounted using screw fasteners. As shown in FIG. 2, the v-shaped bracket 36 is provided with a plurality of holes 40 in first leg 37 and a plurality of larger holes 38 in second leg 39. These holes allow the bracket 36 to be mounted to the support wall 16 with a plurality of fasteners 34. The second leg holes 38 are sized so that the fasteners 34 may fit entirely therethrough. The first leg holes 40 are sized so that the body fasteners 34 will pass through but the head of fasteners 34 will not. In this way first leg 37 is forced against support wall 16 and the bracket is held in place.

In a second embodiment, as shown in FIG. 4, the shelf structure 10 is formed from a solid piece of material rather than a frame structure. Like the frame embodiment described above, this embodiment has a shelf part 12 and a brace part 14 which form an angle A with each other. The shelf structure of this embodiment is attached to wall 16 in the same manner as the frame embodiment described above.

The angle A formed between the horizontal shelf part 12 and brace part 14 of shelf structure 10 is typically 45°. This angle is preferred as this provides the optimal distribution of forces by shelf structure 10 onto the support wall 16. However, it will be clear to one skilled in the art, that this angle may be varied plus or minus several degrees without detrimentally affecting the characteristics of shelf structure 10 of the present invention.

The frame of shelf structure 10 may be made from any suitable material such as wood, plastic, or metal that can be cut, bent, or otherwise formed into the desired shape. The frame members may be joined together with nails, glue, solder or the like. The solid embodiment of the present invention may likewise be made of the above-described materials.

The inner and outer shelf cover members, 18 and 20, used in combination with the frame embodiment of the present invention are formed from paper, cardboard, wood, plastic, metal or any other resilient material. The shelf cover members are attached to the frame by gluing, nailing or any other suitable means.

The honeycomb material used in combination with the frame embodiment of the invention is any suitably shaped and sized honeycomb material preferable made of paper or cardboard.

The bracket 36 and the fasteners 34 are made from any suitable material such as plastic or metal; however, the preferred material is aluminum.

What is claimed is:

1. A removably mountable shelf assembly comprising:

a unitary rigid shelf structure in the form of a panel folded into an acute V-shape, the panel having a first end, a second end spaced from and parallel to said first end, two side edges extending between the first and second ends, a first surface forming an outer surface of the V-shape, and a second surface uniformly spaced from the first surface and forming an inner surface of the V-shape, the first and second surfaces extending at uniform spacing to form respective outer and inner edges of the first and second ends, the V-shape having a smoothly rounded apex disposed intermediate and parallel to said first and second ends, a portion of the panel between the apex and the first end being a shelf part and a portion of the panel between the apex and the second end being a brace part, and an angle bracket having a first leg adapted for attachment to an upright support surface and a second leg joined at an acute angle to the first leg, the first end of the shelf structure being provided with a slot having an opening adjacent to the second surface and extending at an acute angle into the panel toward the first surface, the slot being sized to slidably receive the second leg of the angle bracket, the lengths of the first and second legs of the angle bracket being less than the spacing between the first and second surfaces of the panel, such that the bracket does not extend beyond the first and second surfaces or beyond a plane containing the outer and inner edges of the first end of the panel when the second leg is fully inserted into the slot.

2. A shelf assembly according to claim 1 wherein the first leg of the angle bracket is provided with at least one mounting hole for attaching the bracket to an upright support surface by a threaded fastener, and the second leg is provided with at least one access hole, each access hole being aligned with a corresponding mounting hole to permit rotation of a fastener in the mounting hole by a driving tool inserted through the access hole.

3. A shelf assembly according to claim 1 wherein the panel of the shelf structure has a hollow core.

4. A shelf assembly according to claim 3 wherein the hollow core contains a honeycomb member having prismatic cells aligned perpendicularly to the first and second surfaces of the panel.

5. A shelf assembly according to claim 1 wherein the outer and inner edges of the parallel first and second ends of the folded panel lie in a plane that is substantially perpendicular to the shelf part of the shelf structure.

6. A shelf assembly according to claim 1 wherein the folded panel comprises:

a frame having first and second elongated end frame members forming the first and second ends of the panel and first and second V-shaped side frame members forming the side edges of the panel;

a first sheet member conforming to the outside of the V-shaped side frame members and bonded to the end frame and side frame members to form the outer surface of the panel;

a second sheet member conforming to the inside of the V-shaped side frame members and bonded to the end frames and side frame members to form the inner surface of the panel, the frame and the first and second sheet members defining an enclosed space; and a honeycomb member disposed within said enclosed space, said honeycomb member having prismatic cells aligned perpendicularly to the first and second sheet members.

7. A removably mountable shelf assembly comprising:

a unitary rigid shelf structure in the form of a panel folded into an acute V-shape, the panel comprising a frame having parallel first and second elongated end frame members and first and second V-shaped side frame members, each V-shaped side frame member having a first leg joined to a second leg in a smoothly rounded arc, a free end of the first leg of each side frame member being joined perpendicularly to a corresponding end of the first end frame member to define a shelf part that is perpendicular to a plane defined by the first and second end frame members, and a free end of each second leg of each side frame member being joined perpendicularly to a corresponding end of the second end frame member to define a brace part;

a first sheet member conforming to the outside of the V-shaped side frame members and bonded to the end frame and side frame members to form an outer surface of the panel;

a second sheet member uniformly spaced from the first sheet member, the second sheet member conforming to the inside of the V-shaped side frame members and bonded to the end frames and side frame members to form an inner surface of the panel, the frame and the first and second sheet member defining an enclosed space; and a honeycomb member disposed within said enclosed space, said honeycomb member having prismatic cells aligned perpendicularly to the first and second sheet members; and an angle bracket having a first leg adapted for attachment to an upright support surface and a second leg joined at an acute angle to the first leg, the first end frame member of the shelf structure being provided with a slot having an opening adjacent to the second sheet member and extending at an acute angle into the end frame member toward the first surface, the slot being sized to slidably receive the second leg of the angle bracket, the lengths of the first and second legs of the angle bracket being less than the spacing between the fist and second sheet members, such that the bracket does not extend beyond the first and second sheet members and the first end members of the shelf structure when the second leg of the bracket is fully inserted into the slot.

* * * * *